US007267326B2

(12) United States Patent
Dedering

(10) Patent No.: US 7,267,326 B2
(45) Date of Patent: Sep. 11, 2007

(54) AUTOMATIC PRIMING SYSTEM

(75) Inventor: Daniel E. Dedering, Elkhart Lake, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 11/346,901

(22) Filed: Feb. 3, 2006

(65) Prior Publication Data

US 2006/0249860 A1 Nov. 9, 2006

Related U.S. Application Data

(60) Provisional application No. 60/677,866, filed on May 5, 2005.

(51) Int. Cl.
*F02M 1/16* (2006.01)

(52) U.S. Cl. ..... 261/35; 123/179.12; 123/179.13; 261/DIG. 8

(58) Field of Classification Search ..... 261/35, 261/DIG. 8, DIG. 67, DIG. 73; 123/179.12, 123/179.13
See application file for complete search history.

(56) References Cited

U.S. PATENT DOCUMENTS

| | | | | |
|---|---|---|---|---|
| 1,693,732 | A | 12/1928 | Stokes | 123/179.9 |
| 2,598,147 | A | 5/1952 | Tescher | 123/495 |
| 3,805,758 | A | 4/1974 | May | 123/495 |
| 4,159,012 | A | 6/1979 | Pizzuto et al. | 123/65 R |
| 4,394,852 | A | 7/1983 | Tuckey et al. | 123/179.9 |
| 4,455,266 | A | 6/1984 | Gerhardy | 261/35 |
| 4,509,472 | A | 4/1985 | Slattery | 123/179.16 |
| 4,814,114 | A | 3/1989 | Charmley | 261/35 |
| 4,862,848 | A * | 9/1989 | Kobayashi et al. | 123/179.9 |
| 4,911,116 | A * | 3/1990 | Prohaska et al. | 123/179.13 |
| 5,063,891 | A * | 11/1991 | Noisier | 123/179.9 |
| 5,740,781 | A * | 4/1998 | Scott et al. | 123/437 |
| 5,803,035 | A | 9/1998 | Guntly | 123/179.11 |
| 6,079,379 | A * | 6/2000 | Cobb, Jr. | 123/73 B |
| 6,135,429 | A | 10/2000 | Woody | 261/35 |
| 6,152,431 | A | 11/2000 | Stenz et al. | 261/34.1 |
| 6,186,117 | B1 | 2/2001 | Matte | 123/437 |
| 6,273,037 | B1 * | 8/2001 | Cobb, Jr. | 123/73 B |
| 6,286,469 | B1 | 9/2001 | Cobb, Jr. | 123/73 C |

(Continued)

FOREIGN PATENT DOCUMENTS

| | | | | |
|---|---|---|---|---|
| EP | 306856 | A2 * | 3/1989 | 261/DIG. 8 |

*Primary Examiner*—Richard L. Chiesa
(74) *Attorney, Agent, or Firm*—Baker & Daniels LLP

(57) ABSTRACT

An automatic priming system for internal combustion engines, which is operable to prime the carburetor of the engine at engine cranking speeds, and is automatically disabled after the engine starts. The automatic priming system is driven by pressure fluctuations within the engine crankcase which are caused by reciprocation of the piston. At engine cranking speeds, fluid communication of positive and negative pressure pulses between the engine crankcase and an accumulator is allowed via a restrictor. The positive and negative pressure pulses are used to drive an air pump, such as a diaphragm air pump, to pump atmospheric air to the carburetor to pressurize the fuel bowl of the carburetor for priming. After the engine starts and the piston reciprocates more rapidly, the restrictor prevents communication of positive and negative pressure pulses between the crankcase and the accumulator, and the pressure within the accumulator is relatively constant and below atmospheric pressure. In this manner, the air pump is no longer driven by the positive and negative pressure pulses and the priming operation is terminated.

18 Claims, 2 Drawing Sheets

U.S. PATENT DOCUMENTS 6,481,403 B1 * 11/2002 Ashcraft et al. ..... 123/179.11
6,523,809 B2 2/2003 Woody ..... 261/35
6,571,756 B1 * 6/2003 Rosskamp et al. ..... 123/73 PP
6,595,500 B2 * 7/2003 Osburg et al. ..... 261/34.2
6,622,992 B2 9/2003 Woody ..... 261/35
6,866,019 B1 3/2005 Schmitz ..... 123/344
6,915,772 B2 7/2005 Carpenter ..... 123/179.12
2004/0103864 A1 * 6/2004 Carpenter ..... 123/73 C
2006/0249860 A1 * 11/2006 Dedering ..... 261/35

* cited by examiner

AUTOMATIC PRIMING SYSTEM

CROSS-REFERENCE TO RELATED APPLICATIONS

This application claims the benefit under Title 35, U.S.C. §119(e) of U.S. Provisional Application Ser. No. 60/677,866, entitled AUTOMATIC PRIMING SYSTEM, filed on May 5, 2005.

BACKGROUND OF THE INVENTION

1. Field of the Invention

The present invention relates to small internal combustion engines of the type used with lawn mowers, lawn and garden tractors, snow throwers and other working implements, or with small sport vehicles. Particularly, the present invention relates to a priming system to aid in starting such engines.

2. Description of the Related Art

Small internal combustion engines typically include a carburetor which mixes liquid fuel with atmospheric air drawn through the carburetor to provide an air/fuel combustion mixture to the engine. One type of carburetor commonly used in small engines includes a throat with a venturi through which air is drawn, and into which fuel is drawn for mixing with the intake air, as well as a fuel bowl disposed beneath the throat in which a quantity of liquid fuel is stored. A float valve in the fuel bowl meters a supply of fuel into the fuel bowl from a main fuel tank as necessary as the fuel in the fuel bowl is consumed.

Additionally, such carburetors typically include a manually operable priming feature, such as a priming bulb which is pressed by an operator to pressurize the air space above the fuel in the fuel bowl, thereby forcing a quantity of priming fuel from the fuel bowl into the carburetor throat for mixing with the intake air which is drawn into the carburetor. The priming fuel is in excess of the amount of fuel which is normally supplied for mixing with the intake air to form the combustion mixture, such that a rich air/fuel mixture is initially supplied to the engine to aid in engine starting. After the engine starts, the priming fuel is consumed, and mixing of the air/fuel mixture is thereafter controlled by the fuel metering system of the carburetor during running of the engine.

The foregoing priming feature for carburetors requires an operator to manually press the priming bulb to prime the engine. If the operator does not press the bulb enough times, or if the operator fails to press the priming bulb altogether, pressure will not be built up within the fuel bowl of the carburetor to the extent necessary to supply priming fuel to aid in engine starting. Therefore, difficulty may be encountered in starting the engine. Conversely, if the priming bulb is pressed by an operator too many times, an undesirably large amount of priming fuel may be supplied, which could flood the engine.

Additionally, many carburetors for small engines also include a choke feature, such as a choke valve, which is manually actuated by the operator during engine starting to further enrich the air/fuel mixture initially supplied to the engine. However, until the choke feature is manually deactivated by the operator, the carburetor will continue to supply an enriched air/fuel mixture to the engine after the engine has started, which could flood the engine. Therefore, the operator must remember to deactivate the choke feature after the engine begins to run in order to prevent the engine from flooding.

It is desirable to provide a priming system for use in small internal combustion engines having carburetors which is an improvement over the foregoing.

SUMMARY OF THE INVENTION

The present invention provides an automatic priming system for internal combustion engines, which is operable to prime the carburetor of the engine at engine cranking speeds, and is automatically disabled after the engine starts. The automatic priming system is driven by pressure fluctuations within the engine crankcase which are caused by reciprocation of the piston. At engine cranking speeds, fluid communication of positive and negative pressure pulses between the engine crankcase and an accumulator is allowed via a restrictor. The positive and negative pressure pulses are used to drive an air pump, such as a diaphragm air pump, to pump atmospheric air to the carburetor to pressurize the fuel bowl of the carburetor for priming. After the engine starts and the piston reciprocates more rapidly, the restrictor prevents communication of positive and negative pressure pulses between the crankcase and the accumulator, and the pressure within the accumulator is relatively constant and below atmospheric pressure. In this manner, the air pump is no longer driven by the positive and negative pressure pulses and the priming operation is terminated.

In one embodiment, the accumulator is disposed within the crankcase, and a main restrictor is provided in the form of a small opening between the crankcase and the accumulator. At engine cranking speeds, the pressure fluctuations within the crankcase do not occur rapidly enough for the restrictor to restrict fluid communication of the pressure fluctuations between the crankcase and the accumulator, such that the pressures in the crankcase and the accumulator may substantially equalize. In this manner, positive and negative pressure pulses are communicated to the air pump from the accumulator to drive the air pump for priming. After the engine starts, and at engine running speeds, the pressure fluctuations within the crankcase occur very rapidly, and the restrictor restricts communication thereof to the accumulator such that the pressure in the accumulator is relatively constant and slightly below atmospheric pressure. Therefore, no positive or negative pressure pulses are supplied to the air pump to drive the air pump and prime the carburetor after the engine starts, and the priming function is disabled.

Advantageously, because the automatic priming system is driven by pressure pulses from the engine crankcase which are generated by reciprocation of the piston, as controlled by the restrictor and accumulator, the automatic priming system does not require manual priming of the carburetor or manual operation of a choke feature of the carburetor to prime the carburetor for engine starting and to disable the priming function after the engine starts. A further advantage of the automatic priming system is that the positive and negative pressure pulses within the crankcase and the accumulator are not themselves used to directly pressurize the carburetor fuel bowl. Rather, the positive and negative pressure pulses within the crankcase and accumulator drive an air pump, which pumps air from the atmospheric into the fuel bowl to pressurize same for priming. Thus, only relatively clean atmospheric air enters the fuel bowl, and potential contaminants within the crankcase, such as oil, unburnt fuel, and combustion products from the blow-by gasses, for example, do not pass to the fuel bowl of the carburetor.

In one form thereof, the present invention provides an internal combustion engine, including an engine housing including a crankcase and a cylinder; a crankshaft, connecting rod, and piston assembly disposed within the engine housing, the piston reciprocable within the cylinder to generate positive and negative pressure pulses within the crankcase during cranking and running speeds of the engine; a carburetor; and a priming system, including an air pump having an inlet in communication with the atmosphere and an outlet in fluid communication with the carburetor; and an accumulator in fluid communication with the crankcase through a restrictor, and also in driving fluid communication with the air pump, the restrictor dimensioned to allow substantially uninhibited communication of pressure pulses between the crankcase and the accumulator at engine cranking speeds and to dampen communication of pressure pulses between the crankcase and the chamber at engine running speeds; whereby at engine cranking speeds, pressure pulses may pass from the crankcase through the accumulator to drive the air pump and supply atmospheric air to the carburetor for priming, and at engine running speeds, the pressure pulses are substantially absent within the accumulator, the air pump is not driven, and priming is terminated.

In another form thereof, the present invention provides an internal combustion engine, including an engine housing including a crankcase and a cylinder; a crankshaft, connecting rod, and piston assembly disposed within the engine housing, the piston reciprocable within the cylinder to generate positive and negative pressure pulses within the crankcase during cranking and running speeds of the engine; a carburetor; and a priming system, including an accumulator in fluid communication with the crankcase; an air pump having an inlet in communication with the atmosphere and an outlet in fluid communication with the carburetor; and means for allowing pressure pulses to pass from the crankcase through the accumulator to drive the air pump and supply atmospheric air to the carburetor for priming at engine starting speeds and for substantially terminating supply of pressure pulses from the crankcase to the air pump at engine running speeds.

In another form thereof, the present invention provides a method of operating an internal combustion engine, including the steps of cranking a crankshaft, connecting rod, and piston assembly of the engine to reciprocate the piston within a cylinder and to generate positive and negative pressure pulses within a crankcase of the engine; allowing substantially uninhibited fluid communication during cranking between the crankcase and an accumulator in fluid communication with the crankcase; during cranking, conducting pressure pulses from the accumulator to an air pump; driving the air pump with the pressure pulses to supply atmospheric air to a carburetor; starting the engine; and subsequent to starting the engine, preventing substantially the supply of atmospheric air to the carburetor.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an examplary embodiment of the invention, in one form, and such exemplification is not to be construed as limiting the scope of the invention in any manner.

DETAILED DESCRIPTION

Figure 1:
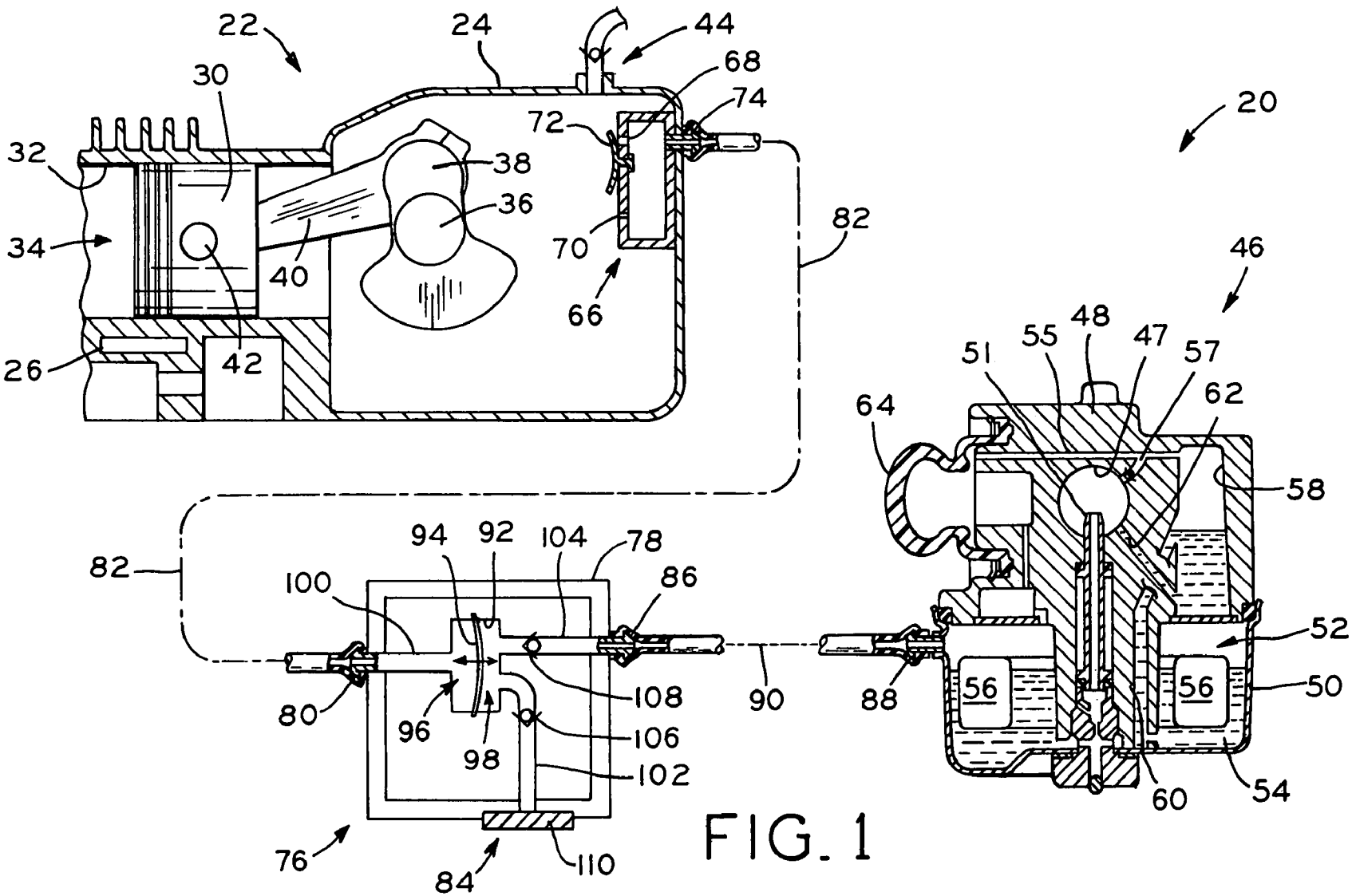
FIG. 1 is a schematic representation of an exemplary automatic priming system according to the present invention.

Referring to FIG. 1, automatic priming system 20 is schematically shown in connection with engine 22. Automatic priming system 20 includes many features similar to the automatic priming system disclosed in U.S. patent application Ser. No. 10/658,063, entitled AUTOMATIC PRIMING SYSTEM, filed on Sep. 9, 2003 and published as U.S. Patent Application Publication No. 2004/0103864 on Jun. 3, 2004, and now U.S. Pat. No. 6,915,772 the disclosure of which is expressly incorporated herein by reference.

Engine 22 may be a small, single or twin cylinder internal combustion engine of the type used in lawn mowers, lawn and garden tractors, snow throwers, generators, other working implements, or in small sport vehicles. Some exemplary engines with which the present priming system may be used are disclosed in U.S. Pat. Nos. 6,295,959, 6,612,275, and 6,941,914, each assigned to the assignee of the present invention, the disclosures of same are expressly incorporated by reference herein. Further, engine 22 may have a valve train of an overhead cam ("OHC"), overhead valve ("OHV"), or side valve/L-head type. Engine 22 includes crankcase 24, cylinder block 26 attached to crankcase 24, and a cylinder head (not shown) attached to cylinder block 26. Optionally, crankcase 24 and cylinder block 26 may be integrally formed with one another, or cylinder block 26 and its cylinder head may be integrally formed with one another. Piston 30 is slidably received within cylinder 32 in cylinder block 26, and a combustion chamber 34 is defined between piston 30 and the cylinder head. Crankshaft 36 is rotatably supported within crankcase 24 via suitable bearings (not shown), and includes eccentric crank pin 38 to which one end of connecting rod 40 is coupled, with the opposite end of connecting rod 40 coupled to wrist pin 42 of piston 30. Crankshaft 36 may be vertically disposed or alternatively, may be horizontally disposed. The crankshaft 36, connecting rod 40, and piston 30 assembly may be manually cranked by an operator for starting engine 22 using a recoil pull-type starter (not shown), or may be non-manually cranked for starting using a starter motor (not shown), for example.

At engine cranking speeds and at engine running speeds, reciprocation of piston 30 within cylinder 32 creates pressure fluctuations, or pressure pulses, within crankcase 24. Specifically, as piston 30 approaches its top dead center ("TDC") position, a negative, or less than atmospheric, pressure is created within crankcase 24 and, as piston 30 retreats from its TDC position toward its bottom dead center ("BDC") position, a positive, or greater than atmospheric, pressure is created within crankcase 24.

Additionally, during combustion of air/fuel mixture within the combustion chamber 34 of engine 22, a portion of the gases within the combustion chamber 34 may pass between piston 30 and cylinder 32 and enter crankcase 24. These gases are typically referred to as "blow-by" gases, and would normally tend to build up within crankcase 24 to create an average positive pressure within crankcase 24. However, the blow-by gases are typically vented out of crankcase 24 through a one-way breather valve 44 connected to crankcase 24. The blow-by gases, upon venting from crankcase 24, may be directed to the intake system of engine 22 for recycling. During the period immediately after venting of blow-by gases through breather valve 44, movement of piston 30 toward its TDC position creates a negative pressure, or partial vacuum condition, within crankcase 24.

In this manner, because breather valve 44 only allows gasses to exit crankcase 24, the average pressure within crankcase 24 is below atmospheric pressure while engine 22 is running, with the pressure fluctuations within crankcase 24 occurring in a generally sinusoidal manner as piston 30 reciprocates between its TDC and BDC positions. Although the average of the sinusoidal pressure fluctuations within crankcase 24 is negative, or below atmospheric, the periodic extremes of the pressure pulses, which occur around the BDC and TDC position of piston 30, are positive and negative, i.e., are above and below atmospheric pressure, respectively. As discussed below, these positive and negative pressure pulses are used in automatic priming system 20 for priming.

As shown in FIG. 1, carburetor 46 of engine 22 includes main body portion 48, having a carburetor throat 49 passing therethrough between an inlet and an outlet (not shown). Carburetor 46 may be of the type disclosed in U.S. Pat. No. 6,152,431, assigned to the assignee of the present invention, the disclosure of which is expressly incorporated herein by reference. Throat 49 includes a venturi (not shown), a throttle valve (not shown), and a choke valve (not shown). Main body portion 48 of carburetor 46 is operably connected to the intake port (not shown) of engine 22 via an intake manifold (not shown), for example, to supply an air/fuel mixture for combustion within the combustion chamber 34 of engine 22. Carburetor 46 further includes fuel bowl 50 containing an air space 52 above a quantity of fuel 54 which is contained within fuel bowl 50. Float valve 56 within fuel bowl 50 meters fuel into fuel bowl 50 from a main fuel tank (not shown) of engine 22.

Carburetor 46 additionally includes an internal vent conduit 55 communicating air space 52 of fuel bowl 50 with throat 49 of carburetor 46. Internal vent conduit 55 additionally includes a check valve 57 therein, which allows air flow from the atmosphere through throat 49 and into air space 52 of fuel bowl 50, but restricts air flow in the opposite direction to allow pressure to build within air space 52 during the priming operation described below. Check valve 57 may be a ball-and-spring valve, or alternatively, may be a disc valve, a duckbill-type valve, a flapper valve, or an umbrella-type valve, for example.

Automatic priming system 20 is described herein with respect to a carburetor of the type including a fuel bowl in which priming is carried out by pressurizing an air space above a quantity of fuel in the fuel bowl to thereby force fuel from the fuel bowl into the throat of the carburetor. However, the automatic priming system 20 is also more generally applicable for use with other types of carburetors or with separate, dedicated priming devices which may operate by being pressurized.

Carburetor 46 additionally includes an extended prime well 58 which is in fluid communication with fuel 54 in fuel bowl 50 via conduit 60, and which is in fluid communication with throat 47 of carburetor 46 via conduit 62. Extended prime well 58 is of the type disclosed and described in detail in the above-incorporated U.S. Pat. No. 6,152,431. Carburetor 46 may optionally further include conventional priming structure of the type disclosed in the above-incorporated U.S. Pat. No. 6,152,431, including resilient primer bulb 64 which may be depressed by an operator to pressurize the air space 52 above fuel 54 in fuel bowl 50 to force a quantity of fuel through main fuel nozzle 51 and into throat 49 of carburetor 46 for priming. As described below, primer bulb 64 is not functionally involved in the operation of automatic priming system 20, but rather may be used independently from automatic priming system 20 when necessary, such as to aid in starting engine 22 in very low working temperatures when an additional amount of priming fuel beyond that which is supplied by automatic priming system 20 may be required.

Still referring to FIG. 1, automatic priming system 20 also includes an accumulator 66 in the form of a box-type housing mounted within crankcase 24 of engine 22. In one embodiment, accumulator has a volume of between approximately 10 and 30 cc. Accumulator 66 is in fluid communication with engine 22 via main restrictor 68 and an optional secondary restrictor 70. Main and secondary restrictors 68 and 70 are shown herein as openings of between approximately 0.035 and 0.070 inches and between approximately 0.020 and 0.030 inches, respectively. Main restrictor 68 may further include a bimetallic valve element 72, shown in FIG. 1 in the form of a disc of bimetallic material attached to the wall of accumulator 66 near main restrictor 68 via a suitable fastener. Other temperature-sensitive materials, such as a thermostat wax, may also be used. When engine 22 is cold, valve element 72 is disposed in a first or open position, shown in FIG. 1, such that valve element 72 is spaced away from main restrictor 68 and does not cover main restrictor 68. When engine 22 is warm, valve element 72 moves to a second or closed position (not shown) in which same covers main restrictor 68. Accumulator 66 also includes fitting 74 fluidly communicating accumulator 66 externally of crankcase 24.

Automatic priming system 20 further includes air pump 76, which is shown herein as a diaphragm air pump, but may be any other type of air pump which may be driven via pressure pulses from crankcase 24 as described below. Air pump 76 may be attached to engine 22 or carburetor 46, or may be a stand-alone component, and generally includes housing 78 having pulse inlet fitting 80 connected to fitting 74 of crankcase 24 via line 82, air inlet 84 in communication with the atmosphere, and air outlet fitting 86 connected to fitting 88 of fuel bowl 50 of carburetor 46 via line 90. Housing 78 also includes an internal chamber 92 having a flexible diaphragm 94 mounted therein and fluidly separating chamber 92 between a pulse chamber 96 on one side of diaphragm 94 and a pump chamber 98 on the opposite side of diaphragm 94. Pulse chamber 96 is in fluid communication with pulse inlet fitting 80 via passage 100, and pump chamber 98 is in fluid communication with air inlet 84 and air outlet fitting 86 via passages 102 and 104 which include check valves 106 and 108 therein, respectively. Air inlet 84 may optionally include filter element 110 for removing dirt and other debris from the atmospheric air which is drawn into air inlet 84.

Upon passage of positive and negative pressure pulses from crankcase 24 and accumulator 66 through line 82 and passage 100 into pulse chamber 96, diaphragm 94 is resiliently reciprocated to pump air from the atmosphere to fuel bowl 50 of carburetor 46 for priming. Specifically, when a negative pressure pulse enters pulse chamber 96 from accumulator 66, diaphragm 94 is reciprocated to the left in FIG. 1, drawing atmospheric air through air inlet 84, passage 102, check valve 106, and into pump chamber 98. Thereafter, when a positive pressure pulse enters pulse chamber 96 from accumulator 66, diaphragm 94 is reciprocated to the right in FIG. 1, closing check valve 106 and forcing air from pump chamber 98 through check valve 108, passage 104, air outlet fitting 86, and thence through line 90 to fuel bowl 50 of carburetor 46.

Figure 2:
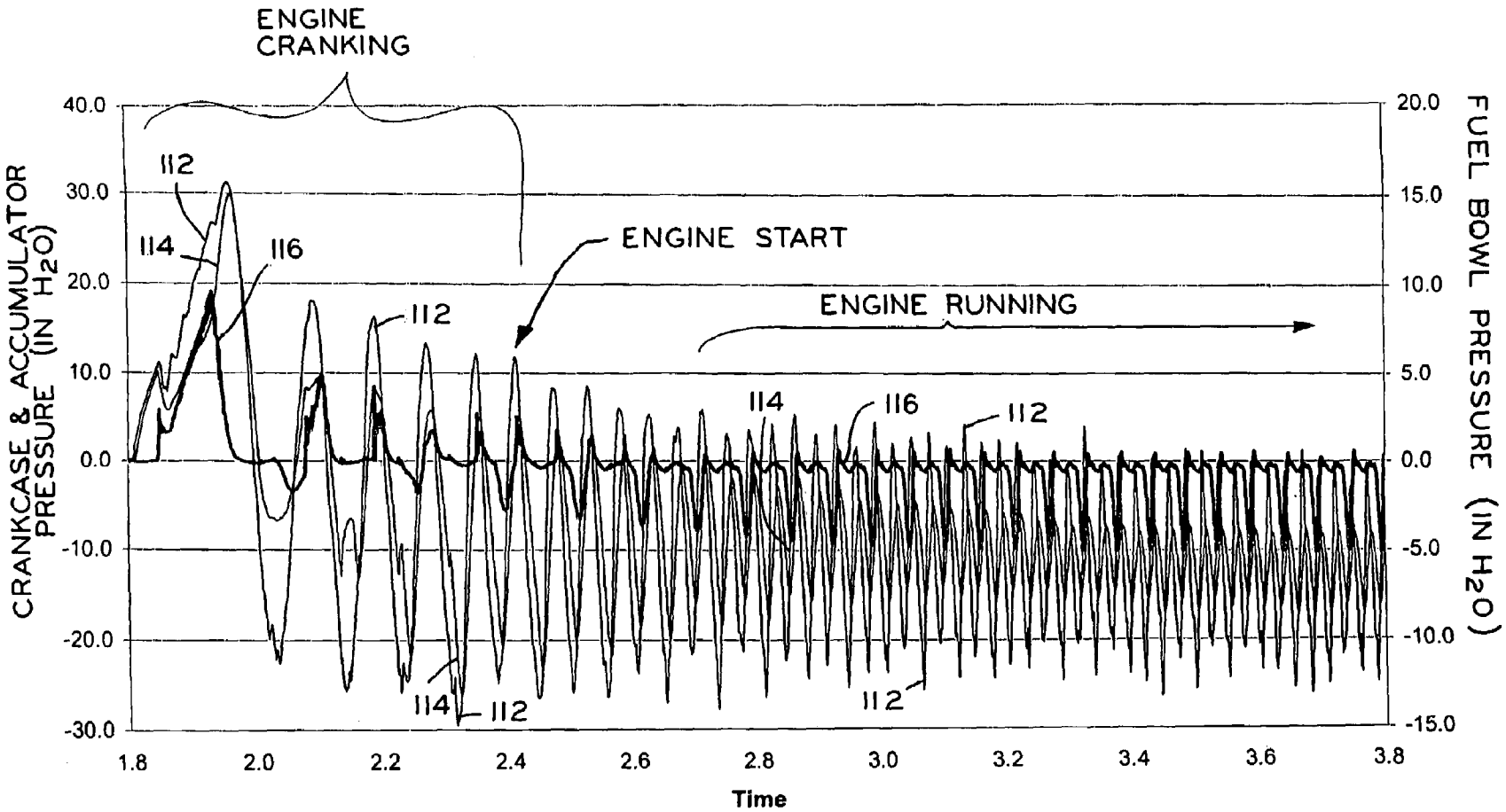
FIG. 2 is a graphic representation of crankcase pressure, accumulator pressure, and carburetor fuel bowl pressure vs. time at engine cranking speeds and just after engine starting.

With further reference to FIG. 2, the operation of automatic priming system 20 will now be described. FIG. 2 shows pressure curves 112, 114, and 116 for crankcase 24, accumulator 66, and fuel bowl 50, respectively, in inches of water vs. time in seconds. When cold starting engine 22, valve element 72 of accumulator 66 is in its open position, as described above. At low engine speeds during engine cranking, which are typically between about 100 and about 800 rpm in most small engines, piston 30 reciprocates relatively slowly, and the positive and negative pressure pulses within crankcase 24 which are created by the reciprocation of piston 30 are freely communicated between crankcase 24 and accumulator 66 through main restrictor 68. Thus, main restrictor 68 does not restrict or inhibit fluid flow between crankcase 24 and accumulator 66 at engine cranking speeds, such that the pressures within crankcase 24 and within accumulator 66 are substantially equalized. During cranking of engine 22, positive and negative pressure pulses within crankcase 24 and accumulator 66 drive air pump 76 as described above to pump atmospheric air into fuel bowl 50 of carburetor 46, thereby pressurizing air space 52 and forcing a quantity of fuel 54 into the throat 47 of carburetor 46 for priming. Concurrently, pressurization of air space 52 also forces fuel 54 through conduit 60 and into extended prime well 58 of carburetor 46.

Referring to FIG. 2, the relationship between the pressures within crankcase 24, accumulator 66 and fuel bowl 50 of carburetor 46 is shown at cranking speeds of engine 22. As may be seen from FIG. 2, at engine cranking speeds, such as between time 1.8 and 2.4 seconds, positive and negative pressure fluctuations of the pressures within crankcase 24 and accumulator 66 occur in a sinusoidal manner, with the pressure fluctuations within accumulator 66 closely following the pressure fluctuations within crankcase 24 due to the full fluid communication between crankcase 24 and accumulator 66 through main restrictor 68. Further, the extremes of these pressure fluctuations rise well above and below atmospheric pressure to generate positive and negative pressure pulses. The positive and negative pressure pulses are communicated from accumulator 66 to air pump 76 as described above. As may be seen from FIG. 2, the pressure within fuel bowl 50 increases responsive to the flow of a pulsed stream of atmospheric air from air pump 76 into fuel bowl 50, wherein the rises in pressure within fuel bowl 50 pressurize air space 52 of fuel bowl 50 for priming, as described above.

After engine 22 starts, the speed of engine 22 rapidly increases during an acceleration period through a range from about 800 rpm to about 1600 rpm for most small engines, shown between times 2.4 and 2.6 in FIG. 2. When engine 22 reaches its running speed at approximately time 2.6 in FIG. 2, which is typically between about 1600 rpm and about 4000 rpm for most small engines, the very rapid reciprocation of piston 30 creates very rapid fluctuations of pressure within crankcase 24. At engine running speeds, such pressure fluctuations occur at such frequency that they cannot be fully communicated through main restrictor 68 to accumulator 66. In other words, main restrictor 68 functions to restrict or dampen the full communication of the pressure pulses within crankcase 24 to accumulator 66 at engine running speeds.

As discussed above and shown in FIG. 2, the average pressure within crankcase 24 at running speeds of engine 22 is below atmospheric pressure, yet periodically exceeds atmospheric pressure at the extremes of the positive pressure fluctuations. However, at engine running speeds, the pressure fluctuations within crankcase 24 are much more pronounced than the corresponding pressure fluctuations within accumulator 66, due to the dampening effect of main restrictor 68. As may be seen in FIG. 2, no positive pressure pulses exist within accumulator 66 at engine running speeds for driving air pump 76 and therefore, the priming operation is terminated and, at engine running speeds, the pressure within fuel bowl 50 remains at substantially atmospheric. Also, after engine 22 starts, fuel within extended prime well 58 of carburetor 46 is drawn into throat 49 through conduit 62, thereby providing an enriched air/fuel mixture to engine 22 until extended prime well 58 runs dry, as described in detail in the above-incorporated U.S. Pat. No. 6,152,431.

As is apparent from the above description, automatic priming system 20 is driven by the pressure fluctuations within crankcase 24 which are caused by the reciprocation of piston 30, and such pressure fluctuations are automatically controlled by main restrictor 68 and accumulator 66 to drive air pump 76 at engine cranking speeds for priming carburetor 46, and are also automatically controlled by main restrictor 68 and accumulator 66 to cease driving air pump 76 at engine running speeds to terminate the priming operation. Therefore, automatic priming system 20 advantageously does not require manual priming of carburetor 46 or manual operation of a choke feature of carburetor 46 by an operator in order to prime carburetor 46 for engine starting, and to disable the priming operation after engine 22 starts.

When engine 22 is cold, valve element 72 is disposed in its open position shown in FIG. 1, such that valve element 72 is spaced away from main restrictor 68 and does not cover main restrictor 68. Thus, fluid communication between crankcase 24 and accumulator 66 is allowed, and the priming system functions as described above. However, after engine 22 starts and temperatures within crankcase 24 increase, valve element 72 deforms, and moves to its closed position in which valve element 72 covers main restrictor 68 and prevents fluid communication between crankcase 24 and accumulator 66 through main restrictor 68. In this manner, the operation of priming system 20 is disabled after engine 22 reaches a warm temperature in order to prevent flooding of engine 22 during warm re-starts of engine 22.

The volume of accumulator 66 and the size of main restrictor 68 may be specifically varied or tuned to provide for disabling of the priming feature at a specific, predetermined engine speed, as described in the above-incorporated U.S. patent application Ser. No. 10/658,063, entitled AUTOMATIC PRIMING SYSTEM, filed on Sep. 9, 2003 and published as U.S. Patent Application Publication No. 2004/0103864 on Jun. 3, 2004. Additionally, the sizes of accumulator 66 and main restrictor 68 may be specifically varied or tuned as necessary depending upon the size of the engine or the running speed of the engine.

Optionally, accumulator 66 may include secondary restrictor 70 which is sized smaller than main restrictor 68. Secondary restrictor 70 does not significantly effect operation of priming system 20 during cold engine starts. However, when the engine reaches a warm temperature and valve element 72 closes, secondary restrictor 70 remains open. During a subsequent warm re-start of engine 20, positive and negative pressure fluctuations are communicated between crankcase 24 and accumulator 66 through secondary restrictor 70 at engine cranking speeds, though to a lesser extent than when main restrictor 68 is open. In this manner, air pump 76 is driven in a less robust manner during warm engine re-starts to provide a lesser amount of air into fuel bowl 50, resulting in a reduced amount of priming of carburetor during warm re-starts of engine 22.

A further advantage of automatic priming system 20 is that the positive and negative pressure pulses within crankcase 24 and accumulator 66 are not used directly to pressurize fuel bowl 50 of carburetor, as in the system described in the above-incorporated U.S. patent application Ser. No. 10/658,063, entitled AUTOMATIC PRIMING SYSTEM, filed on Sep. 9, 2003 and published as U.S. Patent Application Publication No. 2004/0103864 on Jun. 3, 2004. Rather, in automatic priming system 20 described herein, the positive and negative pressure pulses within crankcase 24 and accumulator 66 drive air pump 76, which pumps air from the atmospheric into fuel bowl 50 to pressurize same for priming. Thus, only relatively clean atmospheric air, which has passed through filter element 110 of air pump 76, enters fuel bowl 50, and potential contaminants within crankcase 24, such as oil, unburnt fuel, and combustion products from the blow-by gasses, do not pass into fuel bowl 50 of carburetor 46.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

an engine housing including a crankcase and a cylinder;

a crankshaft, connecting rod, and piston assembly disposed within said engine housing, said piston reciprocable within said cylinder to generate positive and negative pressure pulses within said crankcase during cranking and running speeds of said engine;

a carburetor; and a priming system, comprising:

an air pump having an inlet in communication with the atmosphere and an outlet in fluid communication with said carburetor; and an accumulator in fluid communication with said crankcase through a restrictor, and also in driving fluid communication with said air pump, said restrictor dimensioned to allow substantially uninhibited communication of pressure pulses between said crankcase and said accumulator at engine cranking speeds and to dampen communication of pressure pulses between said crankcase and said chamber at engine running speeds;

whereby at engine cranking speeds, pressure pulses may pass from said crankcase through said accumulator to drive said air pump and supply atmospheric air to said carburetor for priming, and at engine running speeds, said pressure pulses are substantially absent within said accumulator, said air pump is not driven, and priming is terminated.

2. The engine of claim 1, wherein said accumulator is disposed within said crankcase, and said restrictor comprises an opening between said crankcase and said accumulator.

3. The engine of claim 1, wherein said restrictor further comprises a valve element permitting fluid communication between said crankcase and said accumulator at engine cranking speeds and blocking fluid communication between said crankcase and said accumulator at engine running speeds.

4. The engine of claim 3, wherein said valve element is a bimetallic element movable between a first, cold position corresponding to engine cranking speeds permitting fluid communication between said crankcase and said accumulator and a second, warm position corresponding to engine running speeds blocking fluid communication between said crankcase and said accumulator.

5. The engine of claim 1, wherein said air pump comprises an internal chamber including a diaphragm separating said chamber into a pulse chamber and a pump chamber, said pulse chamber in fluid communication with said accumulator and said pump chamber in fluid communication with said pump inlet and outlet.

6. The engine of claim 1, wherein said crankcase includes a breather valve permitting escape of fluid from said crankcase and preventing entry of fluid into said crankcase.

7. The engine of claim 1, wherein said carburetor includes a fuel bowl containing a quantity of fuel with an air space above the fuel, said air pump outlet in fluid communication with said air space whereby at engine cranking speeds, atmospheric air from said air pump passes into said air space and pressurizes said air space.

8. The engine of claim 1, further comprising a secondary restrictor also fluidly communicating said crankcase and said accumulator.

9. An internal combustion engine, comprising:

an engine housing including a crankcase and a cylinder;

a crankshaft, connecting rod, and piston assembly disposed within said engine housing, said piston reciprocable within said cylinder to generate positive and negative pressure pulses within said crankcase during cranking and running speeds of said engine;

a carburetor; and a priming system, comprising:

an accumulator in fluid communication with said crankcase;

an air pump having an inlet in communication with the atmosphere and an outlet in fluid communication with said carburetor; and means for allowing pressure pulses to pass from said crankcase through said accumulator to drive said air pump and supply atmospheric air to said carburetor for priming at engine starting speeds and for substantially terminating supply of pressure pulses from said accumulator to said air pump at engine running speeds.

10. The engine of claim 9, wherein said accumulator is disposed within said crankcase.

11. The engine of claim 9, further comprising means for permitting fluid communication between said crankcase and said accumulator at engine cranking speeds and blocking fluid communication between said crankcase and said accumulator at engine running speeds.

12. The engine of claim 9, wherein said air pump comprises an internal chamber including a diaphragm separating said chamber into a pulse chamber and a pump chamber, said pulse chamber in fluid communication with said accumulator and said pump chamber in fluid communication with said pump inlet and outlet.

13. The engine of claim 9, wherein said crankcase includes a breather valve permitting escape of fluid from said crankcase and preventing entry of fluid into said crankcase.

14. The engine of claim 9, wherein said carburetor includes a fuel bowl containing a quantity of fuel with an air space above the fuel, said air pump outlet in fluid communication with said air space whereby at engine cranking speeds, atmospheric air from said air pump passes into said air space and pressurizes said air space.

15. A method of operating an internal combustion engine, comprising the steps of:

cranking a crankshaft, connecting rod, and piston assembly of the engine to reciprocate the piston within a cylinder and to generate positive and negative pressure pulses within a crankcase of the engine;

allowing substantially uninhibited fluid communication during cranking between the crankcase and an accumulator in fluid communication with the crankcase;

during cranking, conducting pressure pulses from the accumulator to an air pump;

driving the air pump with the pressure pulses to supply atmospheric air to a carburetor;

starting the engine; and subsequent to starting the engine, preventing substantially the supply of atmospheric air to the carburetor.

16. The method of claim 15, wherein said preventing step subsequent to starting the engine comprises inhibiting fluid communication between the crankcase and the accumulator to substantially eliminate positive pressure pulses in the accumulator.

17. The method of claim 15, wherein said allowing step comprises allowing fluid communication between the crankcase and the accumulator through a restrictor.

18. The method of claim 15, wherein said driving step comprises reciprocating a diaphragm within the air pump.

* * * * *